US008109580B1

(12) United States Patent
Didier et al.

(10) Patent No.: US 8,109,580 B1
(45) Date of Patent: Feb. 7, 2012

(54) DISPLAY HOUSING

(75) Inventors: Damon Didier, Orlando, FL (US); Joe Hurst, Orlando, FL (US); Matthew Miller, Orlando, FL (US); Bob Bourassa, Tampa, FL (US); Rick Seal, Tampa, FL (US)

(73) Assignee: Porcelain Promotions, Inc., Tampa, FL (US)

( * ) Notice: Subject to any disclaimer, the term of this patent is extended or adjusted under 35 U.S.C. 154(b) by 426 days.

(21) Appl. No.: 12/455,246

(22) Filed: May 29, 2009

Related U.S. Application Data

(60) Provisional application No. 61/130,477, filed on May 31, 2008.

(51) Int. Cl.
*A47F 5/08* (2006.01)

(52) U.S. Cl. ..... 312/245; 312/7.2

(58) Field of Classification Search ..... 312/7.2, 312/242, 245, 114, 204; 40/700, 712, 722; 348/836; D6/512, 553; 248/475.1
See application file for complete search history.

(56) References Cited

U.S. PATENT DOCUMENTS

| | | | | |
|---|---|---|---|---|
| 4,070,074 | A | 1/1978 | Rohme | |
| D289,873 | S | 5/1987 | Gemmell et al. | |
| D306,720 | S | 3/1990 | Flies | |
| 5,264,765 | A * | 11/1993 | Pecorino et al. | 318/265 |
| D357,495 | S | 4/1995 | Skaggs et al. | |
| D359,727 | S | 6/1995 | Wilson | |
| D414,473 | S | 9/1999 | Kummel et al. | |
| 6,296,331 | B1 | 10/2001 | Tramontina | |
| D454,565 | S | 3/2002 | Harriman | |
| 6,422,671 | B1 | 7/2002 | Lodge et al. | |
| 6,480,243 | B2 * | 11/2002 | Yamamoto | 348/836 |
| D480,961 | S | 10/2003 | Deadman | |
| 6,802,575 | B1 * | 10/2004 | Lee | 312/7.2 |
| 7,201,354 | B1 * | 4/2007 | Lee | 248/231.9 |
| 7,287,737 | B2 * | 10/2007 | Rossi | 248/475.1 |
| 7,397,461 | B1 * | 7/2008 | Graham | 345/156 |
| 2005/0017610 | A1 | 1/2005 | Mistry et al. | |

* cited by examiner

*Primary Examiner* — James O Hansen
(74) *Attorney, Agent, or Firm* — Frijouf, Rust & Pyle, P.A.

(57) ABSTRACT

An enclosure device is disclosed for housing a visual display device adjacent to a surface. The enclosure comprises a cabinet defining a cabinet chamber. A face plate defines a continuous frame. A pyramid body defines a cover chamber. The cabinet chamber receives the visual display device. The face plate compresses against the cabinet, for simultaneously positioning the face plate over the visual display device and positioning the pyramid body adjacent to the wall.

16 Claims, 8 Drawing Sheets

DISPLAY HOUSING

CROSS-REFERENCE TO RELATED APPLICATIONS

This application claims benefit of U.S. Patent Provisional application Ser. No. 61/130,477 filed May 31, 2008. All subject matter set forth in provisional application Ser. No. 61/130,477 is hereby incorporated by reference into the present application as if fully set forth herein.

BACKGROUND OF THE INVENTION

1. Field of the Invention

This invention relates to enclosures and more particularly to an enclosure device for housing a visual display device.

2. Background of the Invention

Providing information and advertising to the general public in public places such as bus and train stations, public meeting places, and public rest rooms and the like presents security and vandalism problems for the purveyor of such information. Deliberate defacing and destruction of the equipment used to provide such information by vandals has challenged the designers and manufacturers to produce vandal proof, or at least vandal resistant equipment. Although the devices of the prior art have addressed the problems of defacing and destruction, none have completely solved these problems associated with the malicious behavior of vandals.

U.S. Pat. No. 4,070,074 to Rohme discloses a cabinet in which the closure or door thereof is rendered less vulnerable to unauthorized tampering which seeks to bypass the lock thereof as a result of the door being latched behind an edge of the cabinet front opening. Thus, opening of the door contemplates a compound movement, i.e. an initial unlatching sliding movement, and then the usual pivotal traverse from its closed into its open position. As a significant improvement, the construction of the within cabinet effectively masks the presence of the structural features which contribute to the door compound movement, whereas this is not the case with prior art cabinet doors and, as a result, such omission in an obvious way, detracts from the effectiveness of the security intended to be gained by the compound door movement.

U.S. Pat. No. 6,296,331 to Tramontina discloses an improved vandal-resistant paper towel dispenser for public washrooms including a mechanism for storing and dispensing paper towels and an outer housing for encasing the mechanism. The outer housing includes a rear mounting surface that is adapted to be secured to a wall, and a shell-like forward surface, connected to the rear mounting surface, for protecting the mechanism from individuals who might have destructive intent. Advantageously, the shell-like forward surface is softly rounded to an extent that it is practically impossible to obtain a handhold on the top or sides of the outer housing, whereby a vandal will be pre-vented from grabbing the dispenser and pulling it off the wall.

U.S. Pat. No. 6,422,671 to Lodge et al. discloses a key cabinet having a frame that defines an interior chamber with at least one panel attached within the interior chamber as well as a door attached to and overlying the frame. The door pivots away from the frame in an opposite direction than the panels to provide the user with simultaneously access to multiple panels as well as the door. In addition, a rail having grooves is provided that may be manufactured in a cost effective manner with a key releasably engaged with a corresponding groove.

U.S. Pat. No. D289,873 to Gemmell et al. discloses an ornamental design for a flat panel display for personal computer.

U.S. Pat. No. D306,720 to Flies discloses an ornamental design for a computer display terminal.

U.S. Pat. No. D357,495 to Skaggs et al. discloses an ornamental design for a point of sale touch screen display.

U.S. Pat. No. D359,727 to Wilson discloses an ornamental design for a computerized information system.

U.S. Pat. No. D454,565 to Harriman discloses an ornamental design for a display housing.

U.S. Pat. No. 414,473 to Kummel et al. discloses an ornamental design for a monitor.

U.S. Pat. No. D480,961 to Deadman discloses an ornamental design for a screen case, as shown and described.

US Patent Application 2005/0017610 to Mistry et al. discloses a wall-mounted cabinet having two components. The first, a back portion, is fixedly connected to a wall, and the second, a cover portion, is pivotally and detachably connected to the second. A vent is formed in the top of the cover portion, but in a manner that does not permit water to enter but does permit heated air generated from with the cabinet to exit. In order to accomplish this, a water-diverting plate is provided on the back portion. The plate is oriented to extend across the width of the vent at an angle, so that water entering the vent is directed towards a gap formed between the wall and the outer surface of the back portion.

Although the devices of the prior art have partially solved the problems associated with malicious vandalism of devices in public places, none has totally solved the problem.

Therefore it is an object of this invention to provide a tamper proof, vandal resistant housing for a computer or display device.

Another object of this invention is to provide a housing for a computer or display device having fluid resistance, whereby water and the like splashed upon the device will not impair the operation of the computer or display device within the housing.

Another object of this invention is to provide a lockably removable housing for a computer or display device wherein the computer or display device may be readily accessible by unlocking the housing.

Another object of this invention is to provide a housing for a computer or display device having a transparent protective face for allowing unrestricted viewing of the display screen while providing the screen protection from malicious mechanical damage.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention an relates to an improved enclosure for housing a visual display device adjacent to a surface. The visual display device includes a monitor for displaying a viewable image. The monitor is electrically coupled to a memory device. The memory device provides electronic signals to the monitor. The enclosure comprises a cabinet including a base panel, a top panel, a bottom panel, a first side panel and a second side panel for defining a cabinet chamber. The cabinet defines a continuous cabinet depth. A face plate including a top elongated plate, a bottom elongated plate, a first side elongated plate and a second side elongated plate defines a continuous frame. The top elongated plate, the bottom elongated plate, the first side elongated plate and the second side elongated plate defines an interior frame aperture. A pyramid body including a top pyramid shield, a bottom pyramid shield, a first side pyramid shield and a second side pyramid shield defines a cover chamber. The face plate and the pyramid body are an integral one piece unit. The face plate and the pyramid body define a continuous cover depth. A fastener secures the cabinet to the surface and the cabinet chamber receives the visual display device. The continuous cabinet depth is less than the continuous cover depth for positioning the cabinet within the cover chamber of the pyramid body. The top elongated plate, the bottom elongated plate, the first side elongated plate and the second side elongated plate compress against the top panel, the bottom panel, the first side panel and the second side panel respectively, for simultaneously positioning the interior frame aperture over the monitor and positioning the pyramid body adjacent to the wall. A coupling extends between the pyramid body and the cabinet for retaining the pyramid body adjacent to the wall.

In a more specific embodiment of the invention, a foam layer is positioned between the base panel of the cabinet and the memory device for compression between the base panel of the cabinet and the memory device. The foam layer provides an expansion force between the base panel of the cabinet and the memory device for maintaining the monitor adjacent to the face plate.

The base panel, the top panel, the bottom panel, the first side panel and the second side panel include a top elastic polymer strip, a bottom elastic polymer strip, a first elastic polymer strip and a second elastic polymer strip respectively, for compression between the cabinet and the face plate. The top elastic polymer strip, the bottom elastic polymer strip, the first elastic polymer strip and the second elastic polymer strip provide an expansion force between the cabinet and the face plate for maintaining engagement of the coupling between the pyramid body and the cabinet.

In a more specific embodiment of the invention, a transparent protective layer is positioned between the monitor and the face plate for protecting the monitor. The coupler includes a cam lever receiver on the cabinet. A cam lock traverses the pyramid body. A cam lever is pivotally secured to the cam lock within the cover chamber of the pyramid body. The cam lever engages the cam lever receiver for locking the pyramid body to the cabinet. The face plate and the top pyramid shield, the bottom pyramid shield, the first side pyramid shield and the second side pyramid shield define an obtuse angle.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
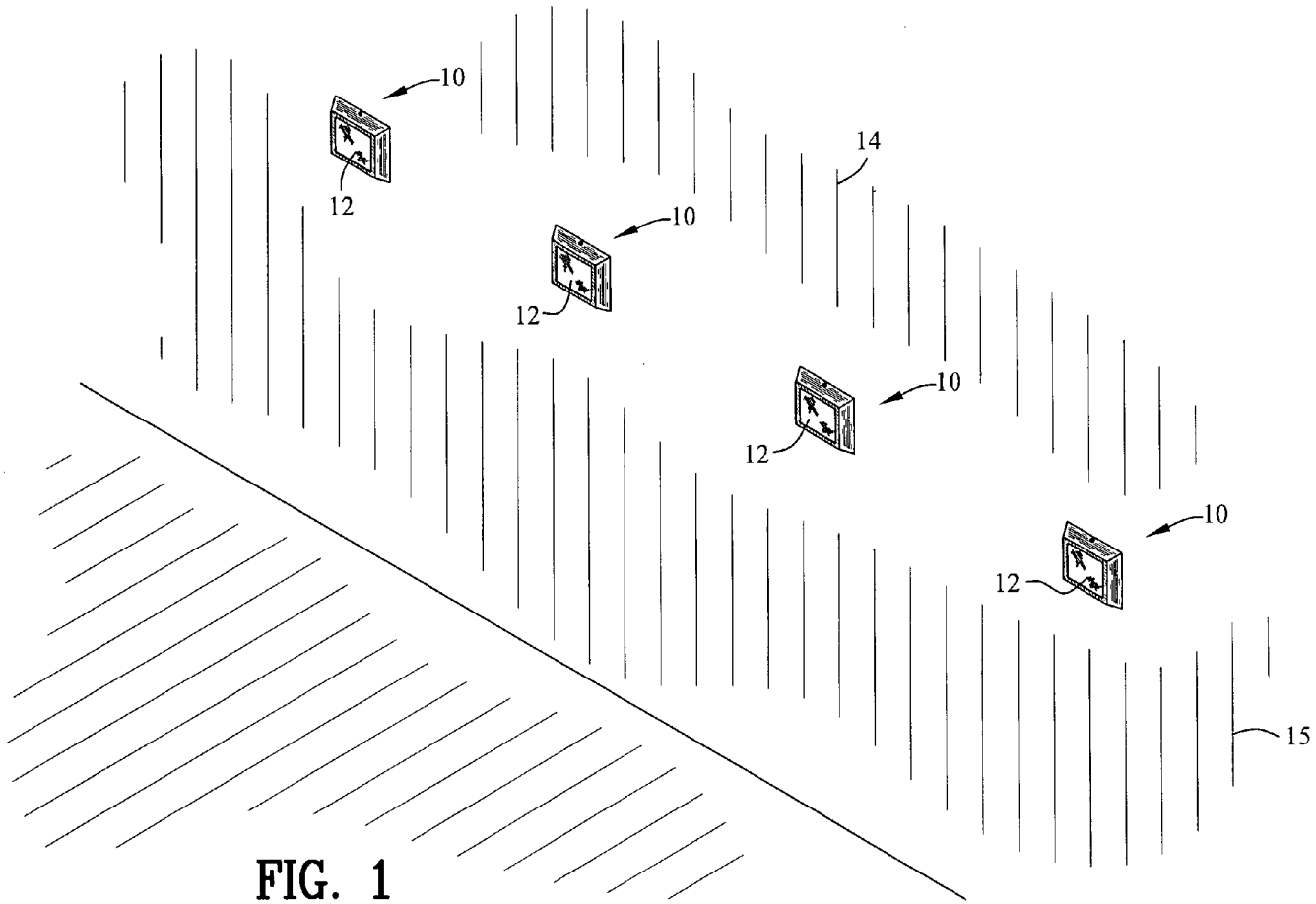
FIG. 1 is an isometric view of a plurality of visual display devices for housing a monitor incorporating the present invention.
Figure 2:
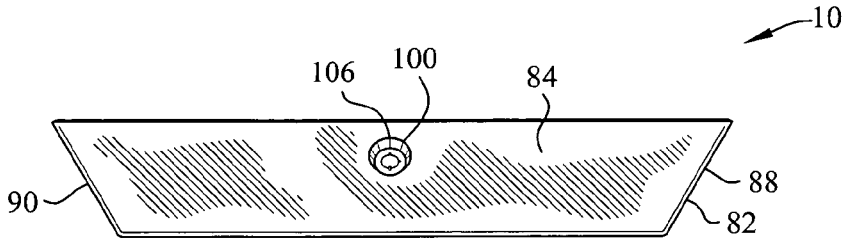
FIG. 2 is a top view of the visual display device of FIG. 1.
Figure 3:
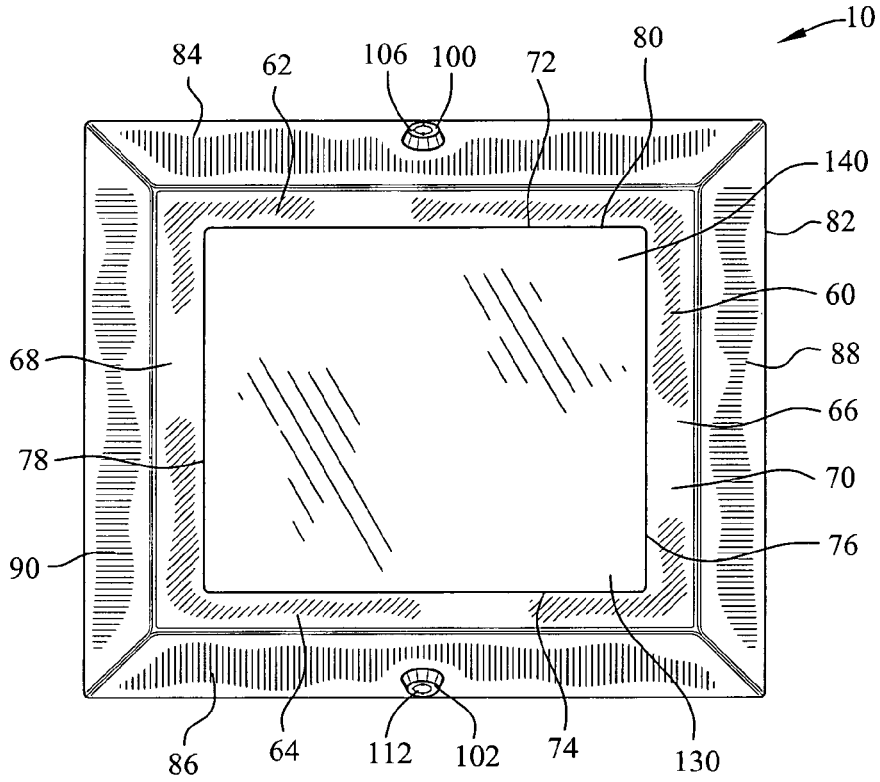
FIG. 3 is a front view of FIG. 2.
Figure 4:
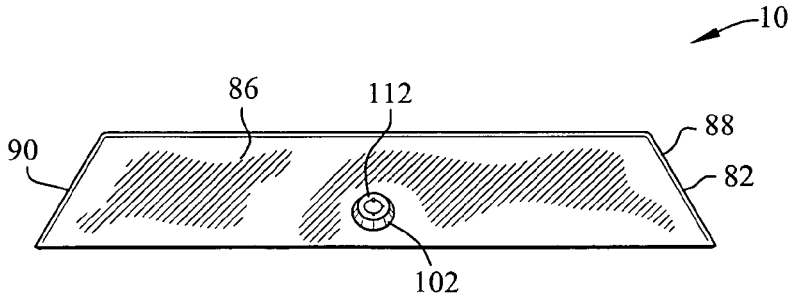
FIG. 4 is a bottom view of FIG. 3.
Figure 5:
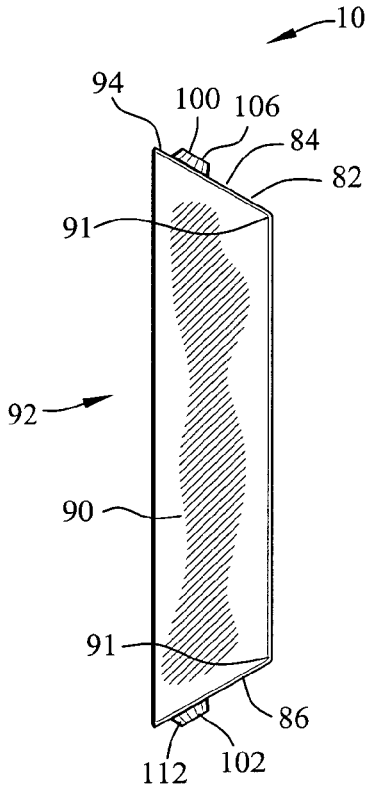
FIG. 5 is a left side view of FIG. 3.
Figure 6:
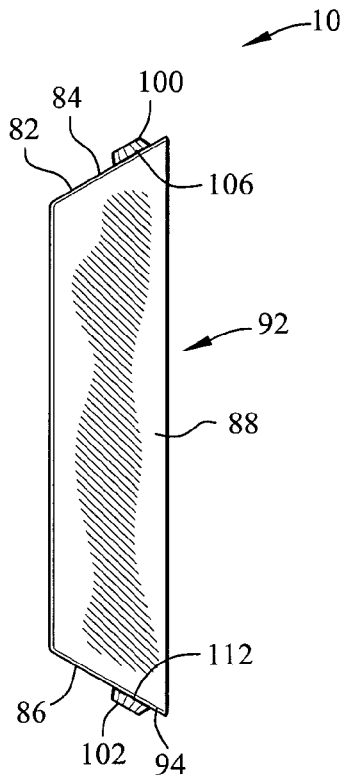
FIG. 6 is a right side view of FIG. 3.
Figure 7:
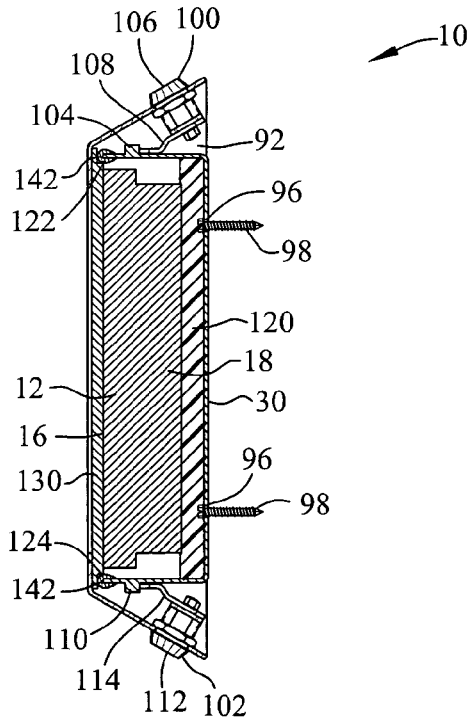
FIG. 7 is a sectional view along line 7-7 in FIG. 1.
Figure 8:
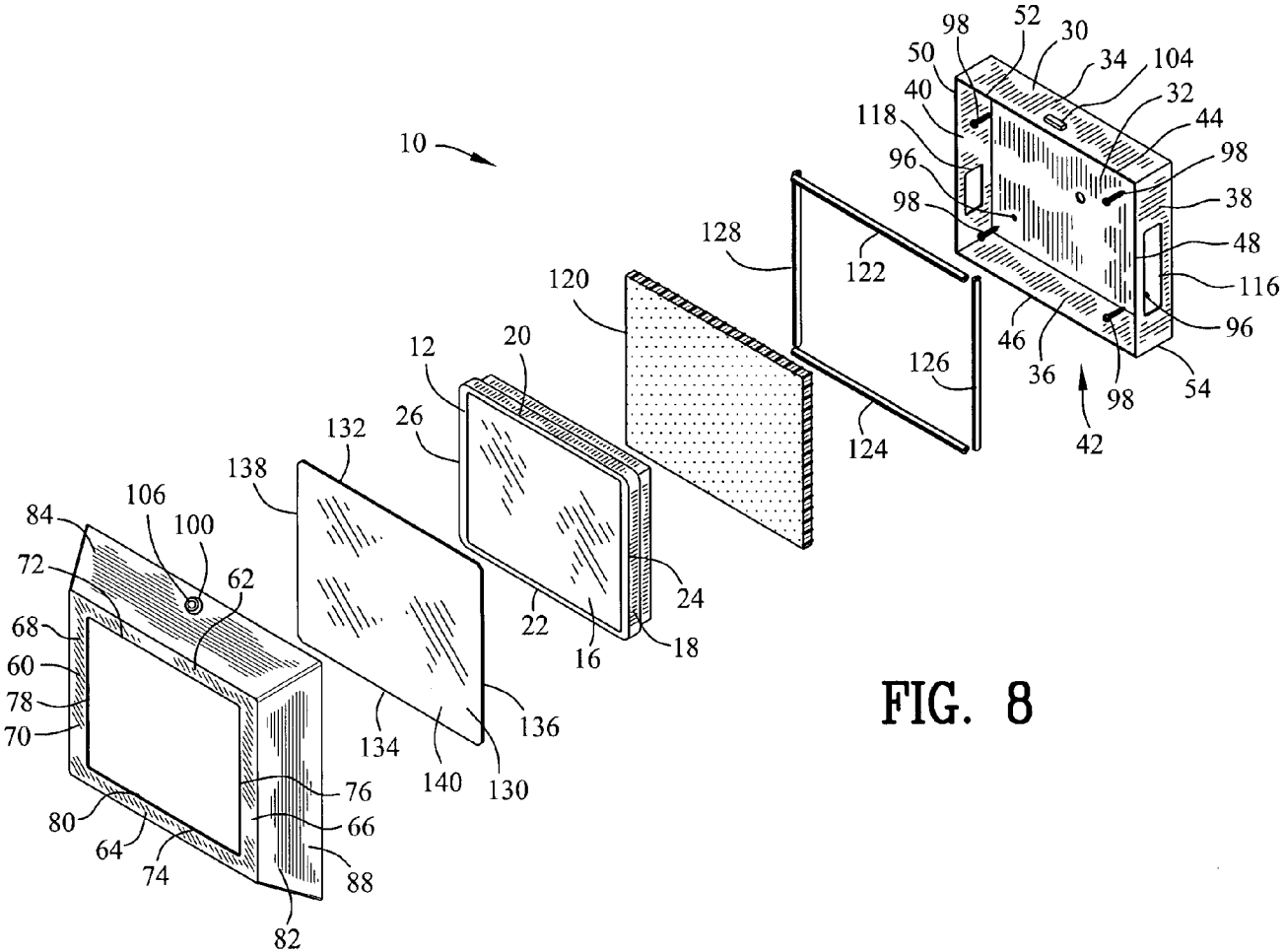
FIG. 8 is an isometric and exploded view of the present invention.

FIGS. 1-18 are various views of an enclosure 10 for housing a visual display device 12 adjacent to a surface 14. The visual display device 12 includes a monitor 16 for displaying a viewable image. He monitor 16 may include but is not limited to a thin film transistor liquid crystal display. The monitor 16 is electrically coupled to a memory device 18. The memory device 18 provides electronic signals to the monitor 16. The memory device 18 may include but is not limited to, optical discs, magnetic storage, or static memory devices. The memory device 18 is coupled to a central processing unit for controlling the iconic signals between the monitor 16 and the memory device 18. The monitor has a first edge 20, a second edge 22, a third edge 24 and a fourth edge 26 for defining a display area 28.

The visual display device 12 provides information regarding advertisements, promotional information, and/or other data. The enclosure 10 may be positioned on a vertical surface, a horizontal surface or any inclined surface. The enclosure 10 may be located in an exterior environment, war and terror environment. Furthermore, the enclosure 10 may be located at many different locations including but not limited to public places, transportation terminals or public bathrooms.

The enclosure 10 comprises a cabinet 30 including a base panel 32, a top panel 34, a bottom panel 36, a first side panel 38 and a second side panel 40 for defining a cabinet chamber 42. The top panel 34, the bottom panel 36, the first side panel 38 and the second side panel 40 defining a top edge 44, a bottom edge 46, a first edge 48 and a second edge 50, respectively. The top edge 44, the bottom edge 46, the first edge 48 and second edge 50 define a cabinet aperture 52. The cabinet 30 defines a continuous cabinet depth 54. The cabinet 30 may be constructed from a metallic, polymeric or other rigid material.

A face plate 60 includes a top elongated plate 62, a bottom elongated plate 64, a first side elongated plate 66 and a second side elongated plate 68 for defining a continuous frame 70. The top elongated plate 62, the bottom elongated plate 64, the first side elongated plate 66 and the second side elongated plate 68 define a first interior edge 72, a second interior edge 74, a third interior edge 76 and a fourth interior edge 78, respectively. The first interior edge 72, the second interior edge 74, the third interior edge 76 and the fourth interior edge 78 defines an interior frame aperture 80.

A pyramid body 82 includes a top pyramid shield 84, a bottom pyramid shield 86, a first side pyramid shield 88 and a second side pyramid shield 90 for defining a cover chamber 92. The top elongated plate 62, the bottom elongated plate 64, the first side elongated plate 66 and the second side elongated plate 68 are integral with the top pyramid shield 84, the bottom pyramid shield 86, the first side pyramid shield 88 and the second side pyramid shield 90, respectively. The face plate 60 and the top pyramid shield 84, the bottom pyramid shield 86, the first side pyramid shield 88 and the second side pyramid shield 90 define an obtuse angle 91. The face plate 60 and the pyramid body 82 may be constructed from a metallic, polymeric or other rigid material. The face plate 60 and the pyramid body 82 define a continuous cover depth 94.

The base panel 32 may include one or more bores 96 for receiving a fastener 98. The fastener 98 engages with the surface 14 for securing the cabinet 30 to the surface 14. The fastener 98 may include screws, bolts or other fastening devices. The first side panel 38 may include a first opening 116 for accessing the memory device. Furthermore, the second side panel may include a second opening 118 for accessing the memory device. The first opening 116 and the second opening 118 may be utilized for permitting a wire 129 traversing the first and second openings 116 and 118. The wire 129 may be electrically coupled to a power source 131, an auxiliary computer 133, and/or a wireless device 135.

The cabinet chamber 42 receives the visual display device 12. The continuous cabinet depth 54 of the cabinet 30 is less than the continuous cover depth 94 of the face plate 60 and the pyramid body 82 for positioning the cabinet 30 within the cover chamber 92 of the pyramid body 82. The top elongated plate 62, the bottom elongated plate 64, the first side elongated plate 66 and the second side elongated plate 68 compresses against the top edge 44, the bottom edge 46, the first edge 48 and the second edge 50 respectively, for simultaneously positioning the interior frame aperture 80 over the monitor 16 and positioning the top pyramid shield 84, the bottom pyramid shield 86, the first side pyramid shield 88 and the second side pyramid shield 90 adjacent to the surface 14.

A first coupling 100 extends between the pyramid body 82 and the cabinet 30 for retaining the top pyramid shield 84, the bottom pyramid shield 86, the first side pyramid shield 88 and the second side pyramid shield 90 adjacent to the surface 14. A second coupling 102 extends between the pyramid body 82 and the cabinet 30 for retaining said top pyramid shield 84, the bottom pyramid shield 86, the first side pyramid shield 88 and the second side pyramid shield 90 adjacent to the surface 14.

More specifically, the first coupling 100 may include a first cam lever receiver 104 on the top panel 34. A first cam lock 106 traverses the top pyramid shield 84. A first cam lever 108 is pivotally secured to the first cam lock 106 within the cover chamber 92 of the pyramid body 82. The first cam lever 108 engages the first cam lever receiver 104 for locking the pyramid body 82 to the cabinet 30.

Similarly, the second coupling 102 includes a second cam lever receiver 110 on the bottom panel 36. A second cam lock 112 traverses the bottom pyramid shield 86. A second cam lever 114 is pivotally secured to the second cam lock 112 within the cover chamber 92 of the pyramid body 82. The second cam lever 114 engages the second cam lever receiver 110 for locking the pyramid body 82 to the cabinet 30. Preferably a single key engages both the first cam lock 106 and the second cam lock 112 for permitting the rotation of the first cam lever 108 and the second cam lever 114 respectively. Since the top pyramid shield 84, the bottom pyramid shield 86, the first side pyramid shield 88 and the second side pyramid shield 90 are immediately adjacent to the surface 14, it is very difficult for a person to wedge an object between the pyramid body 82 and the surface 14 in an attempt to remove the enclosure 10 from the surface 14. Furthermore, the overall configuration of both the face plate 60 and the pyramid body 82 makes it difficult for an individual to grasp the enclosure 10.

A foam layer 120 may be positioned between the base panel 32 of the cabinet 30 and the memory device 18 for compression between the base panel 32 of the cabinet 30 and the memory device 18. The foam layer 120 provides an expansion force between the base panel 32 of the cabinet 30 and the memory device 18 for maintaining the monitor 16 adjacent to the face plate 60.

The top edge 44, the bottom edge 46, the first edge 48 and the second edge 50 of the cabinet 30 include a top elastic polymer strip 122, a bottom elastic polymer strip 124, a first elastic polymer strip 126 and a second elastic polymer strip 128 respectively, for compression between the top edge 44, the bottom edge 46, the first edge 48 and the second edge 50 with the face plate 60. The top elastic polymer strip 122, the bottom elastic polymer strip 124, the first elastic polymer strip 126 and the second elastic polymer strip 128 providing an expansion force between the top edge 44, the bottom edge 46, the first edge 48, and the second edge 50, respectively and the face plate 60 for maintaining engagement of the first coupling 100 and the second coupling 102 between the pyramid body 82 and the cabinet 30.

A transparent protective layer 130 may be positioned between the monitor 16 and the face plate 60 for protecting the monitor 16. The transparent protective layer 130 may further include a first layer edge 132, a second layer edge 134, a third layer edge 136 and a four layer edge 138 for defining a layer area 140. The layer area 140 of the transparent protective layer 130 is greater than the cabinet aperture 52 and less than the face plate 60. The first layer edge 132, the second layer edge 134, the third layer edge 136 and the four layer edge 138 includes a continuous groove engaging 142 the top edge 44, the bottom edge 46, the first edge 48 and the second edge 50 respectively for interlocking the transparent protective layer 130 to the cabinet 30.

Figure 9:
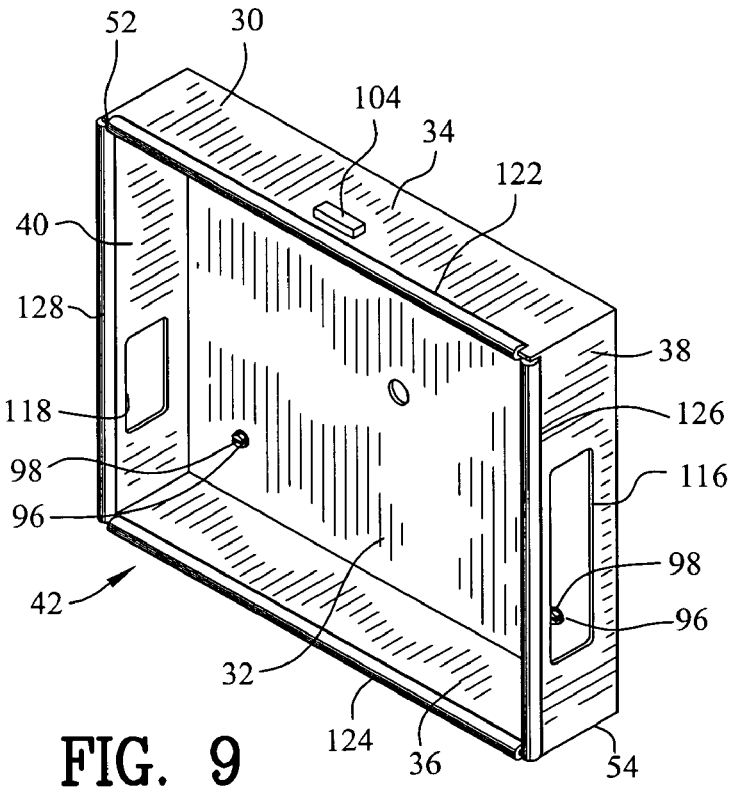
FIG. 9 is an isometric view of a cabinet as shown in FIG. 8.
Figure 10:
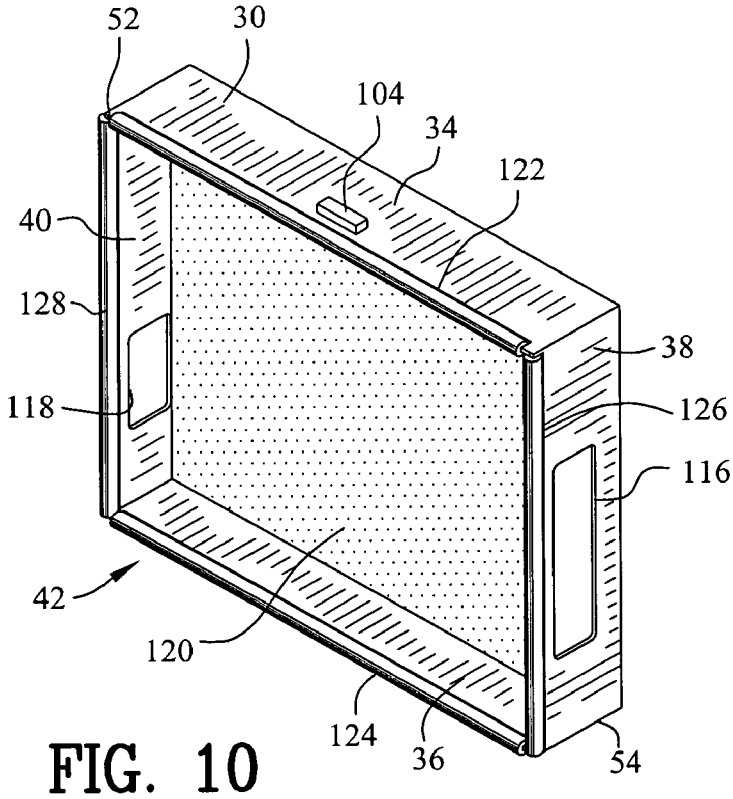
FIG. 10 is a view similar to FIG. 9 including a foam layer positioned within the cabinet.
Figure 11:
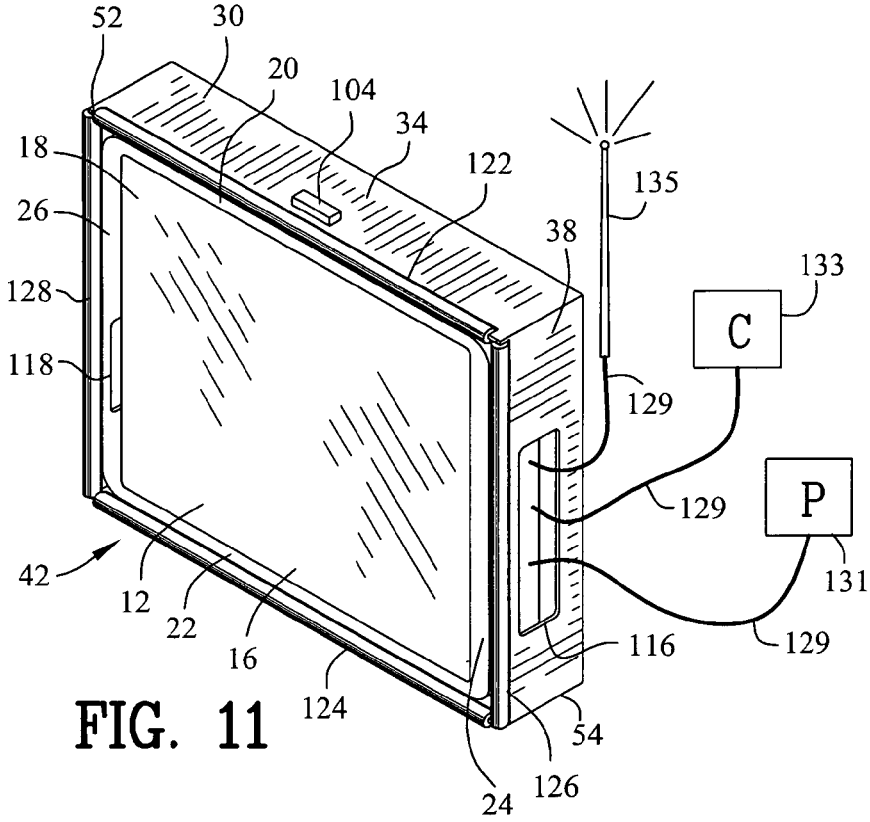
FIG. 11 is a view similar to FIG. 10 including the visual display device positioned within the cabinet.

FIGS. 9-18 illustrates a process of installing the enclosure 10 to a surface 14. FIG. 9, illustrates the cabinet 30 being secured to a wall surface 15 by a plurality of fasteners 98. FIG. 10, illustrates the foam layer 120 being next positioned adjacent to the base panel 32. A minute amount of adhesive may be utilized to retain the foam layer 120 against the base panel 32. In FIG. 11, the visual display device 12 is then installed in to the cabinet chamber 42. The visual display device 12 will then be electrically coupled to the power source 131, auxiliary computer 133 and/or the wireless device 135.

Figure 12:
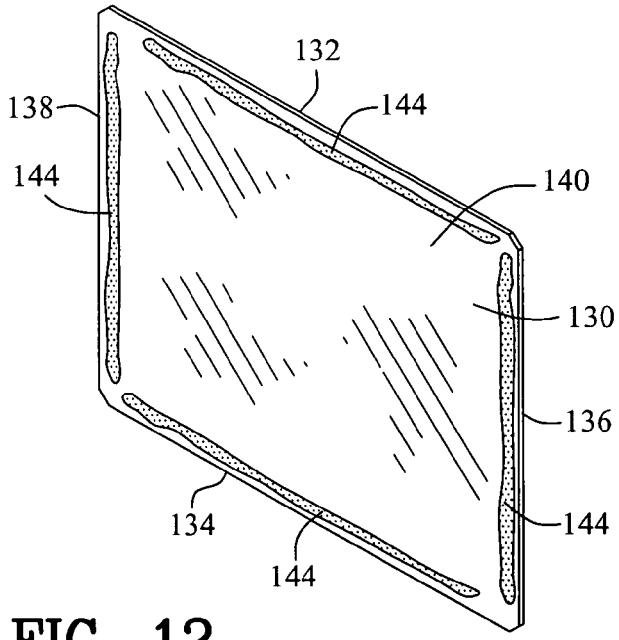
FIG. 12 is an isometric view of a transparent protective layer as shown in FIG. 8.
Figure 13:
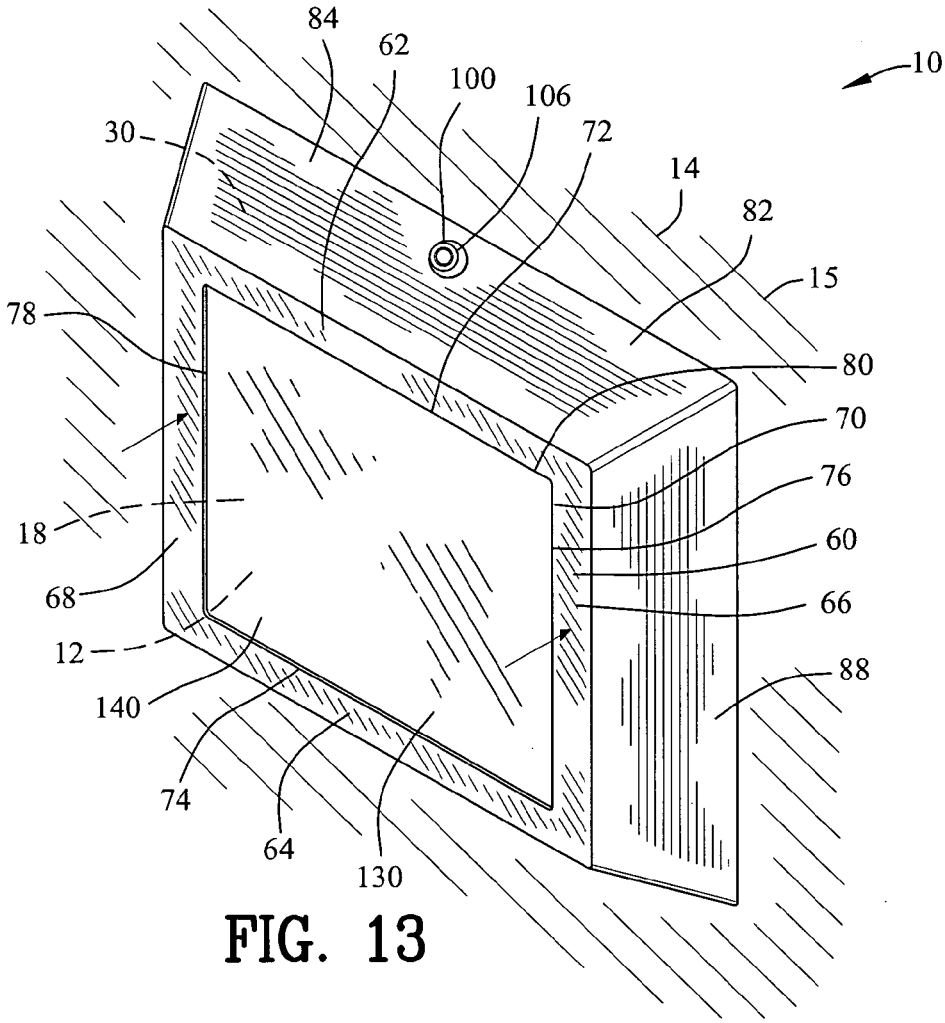
FIG. 13 is an enlarged view of FIG. 1 illustrating a compressive force being applied to the visual display device.
Figure 14:
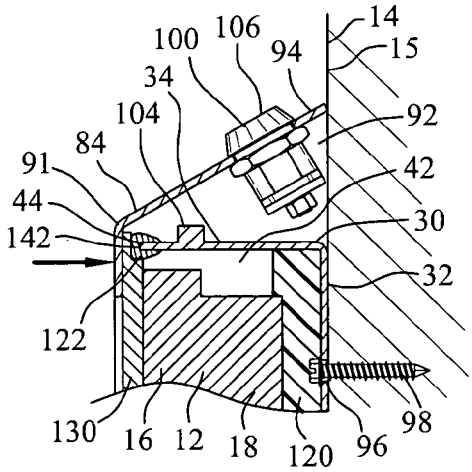
FIG. 14 is a sectional view along line 14-14 in FIG. 13.
Figure 15:
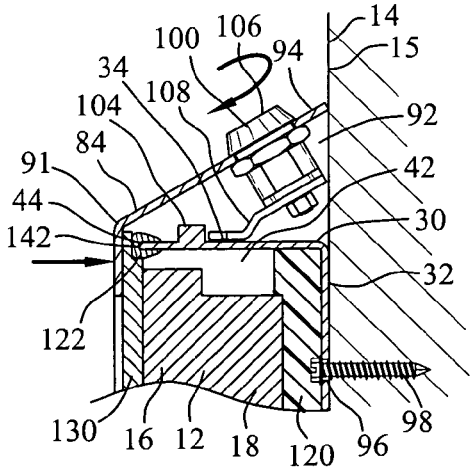
FIG. 15 is a view similar to FIG. 14 illustrating a first coupler engaging the cabinet.
Figure 16:
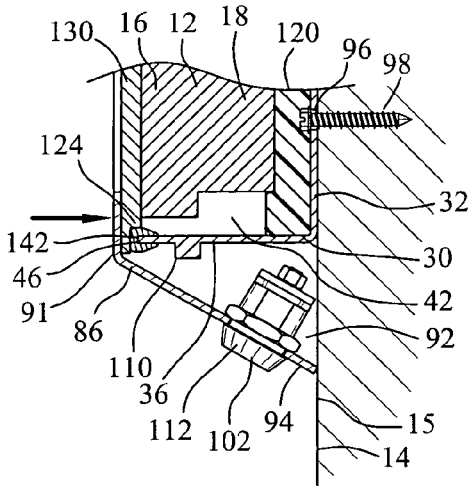
FIG. 16 is a sectional view along line 16-16 in FIG. 13.
Figure 17:
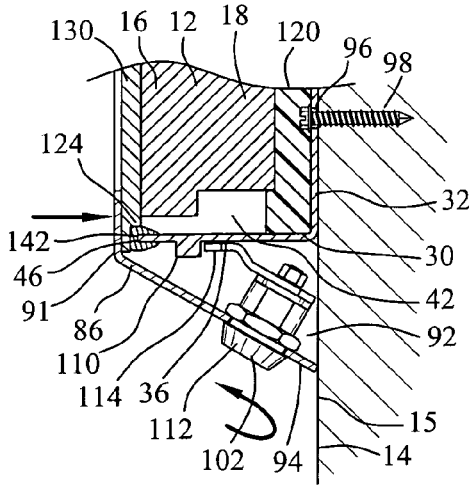
FIG. 17 is a view similar to FIG. 16 illustrating a second coupler engaging the cabinet.
Figure 18:
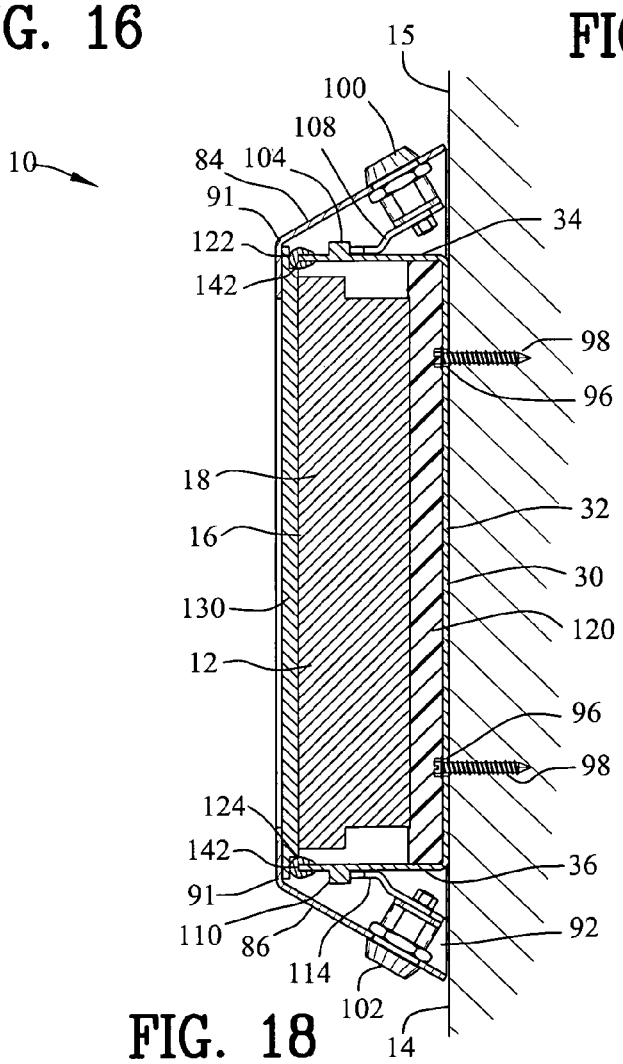
FIG. 18 is an enlarged view of FIG. 7.

FIG. 12 illustrates an adhesive 144 being positioned adjacent to the first layer edge 132, the second layer edge 134, the third layer edge 136, and the fourth layer edge 138 of the transparent protective layer 133. The transparent protective layer 130 is then depressed against the base plate 160. The cured adhesive 144 prevents displacement of the transparent protective layer 130 relative to the base plate 60.

FIGS. 13-17 illustrate a force being applied against the face plate 60 in order to compress the foam layer 120 between the base panel 32 and the memory device 18. The compression of the foam layer 120 further provides clearance for the first and second cam levers 108 and 114, to be pivoted into alignment with the first and second cam lever receivers 104 and 110, respectively. Upon removal of the force applied to the face plate 60, the foam layer 120 expands to bring the first and second cam levers 108 and 114 into contact with the first and second cam lever receivers 104 and 110. During engagement between the first and second cam levers 108 and 114 with the first and second cam lever receivers 104 and 110, the foam layer 120 continues to provide expansion force between the base panel 32 and the memory device 18 for preventing displacement of the cabinet 30 relative to the pyramid body 82. Furthermore, during engagement between the first and second cam levers 108 and 114 with the first and second cam lever receivers 104 and 110, the top elastic polymer strip 122, the bottom elastic polymer strip 124, the first elastic polymer strip 126 and the second elastic polymer strip 128 remaining in a compressed state. The compressed state between the top elastic polymer strip 122, the bottom elastic polymer strip 124, the first elastic polymer strip 126 and the second elastic polymer strip 128 in the transparent protective layer 130 further prevents displacement of the cabinet 30 relative to the pyramid body 82.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An enclosure for housing a visual display device adjacent to a surface, the visual display device including a monitor for displaying a viewable image, the monitor being electrically coupled to a memory device, the memory device providing electronic signals to the monitor, the enclosure, comprising:

a cabinet including a base panel, a top panel, a bottom panel, a first side panel and a second side panel for defining a cabinet chamber;

said cabinet defining a continuous cabinet depth;

a face plate including a top elongated plate, a bottom elongated plate, a first side elongated plate and a second side elongated plate for defining a continuous frame;

said top elongated plate, said bottom elongated plate, said first side elongated plate and said second side elongated plate defining an interior frame aperture;

a pyramid body including a top pyramid shield, a bottom pyramid shield, a first side pyramid shield and a second side pyramid shield for defining a cover chamber;

said face plate and said pyramid body being an integral one piece unit;

said face plate and said pyramid body defining a continuous cover depth;

a fastener securing said cabinet to the surface;

said cabinet chamber receiving the visual display device;

said continuous cabinet depth being less than said continuous cover depth for positioning said cabinet within said cover chamber of said pyramid body;

said top elongated plate, said bottom elongated plate, said first side elongated plate and said second side elongated plate compressing against said top panel, said bottom panel, said first side panel and said second side panel respectively, for simultaneously positioning said interior frame aperture over the monitor and positioning said pyramid body adjacent to the surface; and a coupling extending between said pyramid body and said cabinet for retaining said pyramid body adjacent to the surface.

2. An enclosure for housing a visual display device as set forth in claim 1, wherein a foam layer is positioned between said base panel of said cabinet and the memory device for compression between said base panel of said cabinet and the memory device; and said foam layer providing an expansion force between said base panel of said cabinet and the memory device for maintaining the monitor adjacent to said face plate.

3. An enclosure for housing a visual display device as set forth in claim 1, wherein said base panel, said top panel, said bottom panel, said first side panel and said second side panel include a top elastic polymer strip, a bottom elastic polymer strip, a first elastic polymer strip and a second elastic polymer strip respectively, for compression between said cabinet and said face plate; and said top elastic polymer strip, said bottom elastic polymer strip, said first elastic polymer strip and said second elastic polymer strip providing an expansion force between said cabinet and said face plate for maintaining engagement of said coupling between said pyramid body and said cabinet.

4. An enclosure for housing a visual display device as set forth in claim 1, wherein a transparent protective layer is positioned between the monitor and said face plate for protecting the monitor.

5. An enclosure for housing a visual display device as set forth in claim 1, wherein said coupler including a cam lever receiver on said cabinet;

a cam lock traversing said pyramid body;

a cam lever pivotally secured to said cam lock within said cover chamber of said pyramid body; and said cam lever engaging said cam lever receiver for locking said pyramid body to said cabinet.

6. An enclosure for housing a visual display device as set forth in claim 1, wherein said face plate and said top pyramid shield, said bottom pyramid shield, said first side pyramid shield and said second side pyramid shield define an obtuse angle.

7. An enclosure for housing a visual display device adjacent to a surface, the visual display device including a monitor for displaying a viewable image, the monitor being electrically coupled to a memory device, the memory device providing electronic signals to the monitor, the monitor having a first edge, a second edge, a third edge and a fourth edge for defining a display area, the enclosure, comprising:

a cabinet including a base panel, a top panel, a bottom panel, a first side panel and a second side panel for defining a cabinet chamber;

said top panel, said bottom panel, said first side panel and said second side panel defining a top edge, a bottom edge, a first edge and a second edge, respectively;

said top edge, said bottom edge, said first edge and said second edge defining a cabinet aperture;

said cabinet defining a continuous cabinet depth;

a face plate including a top elongated plate, a bottom elongated plate, a first side elongated plate and a second side elongated plate for defining a continuous frame;

said top elongated plate, said bottom elongated plate, said first side elongated plate and said second side elongated plate defining a first interior edge, a second interior edge, a third interior edge and a fourth interior edge, respectively;

said first interior edge, said second interior edge, said third interior edge and said fourth interior edge defining an interior frame aperture;

a pyramid body including a top pyramid shield, a bottom pyramid shield, a first side pyramid shield and a second side pyramid shield for defining a cover chamber;

said top elongated plate, said bottom elongated plate, said first side elongated plate and said second side elongated plate being integral with said top pyramid shield, said bottom pyramid shield, said first side pyramid shield and said second side pyramid shield, respectively;

said face plate and said pyramid body defining a continuous cover depth;

a fastener securing said cabinet to the surface;

said cabinet chamber receiving the visual display device;

said continuous cabinet depth of said cabinet being less than said continuous cover depth of said face plate and said pyramid body for positioning said cabinet within said cover chamber of said pyramid body;

said top elongated plate, said bottom elongated plate, said first side elongated plate and said second side elongated plate compressing against said top edge, said bottom edge, said first edge and said second edge respectively, for simultaneously positioning said interior frame aperture over the monitor and positioning said top pyramid shield, said bottom pyramid shield, said first side pyramid shield and said second side pyramid shield adjacent to the surface;

a first coupling extending between said pyramid body and said cabinet for retaining said top pyramid shield, said bottom pyramid shield, said first side pyramid shield and said second side pyramid shield adjacent to the surface; and a second coupling extending between said pyramid body and said cabinet for retaining said top pyramid shield, said bottom pyramid shield, said first side pyramid shield and said second side pyramid shield adjacent to the surface.

8. An enclosure for housing a visual display device as set forth in claim 7, wherein a foam layer is positioned between said base panel of said cabinet and the memory device for compression between said base panel of said cabinet and the memory device; and said foam layer providing an expansion force between said base panel of said cabinet and the memory device for maintaining the monitor adjacent to said face plate.

9. An enclosure for housing a visual display device as set forth in claim 7, wherein said top edge, said bottom edge, said first edge and said second edge of said cabinet include a top elastic polymer strip, a bottom elastic polymer strip, a first elastic polymer strip and a second elastic polymer strip respectively, for compression between said top edge, said bottom edge, said first edge and said second edge and said face plate; and said top elastic polymer strip, said bottom elastic polymer strip, said first elastic polymer strip and said second elastic polymer strip providing an expansion force between said top edge, said bottom edge, said first edge, and said second edge, respectively and said face plate for maintaining engagement of said first coupling and said second coupling between said pyramid body and said cabinet.

10. An enclosure for housing a visual display device as set forth in claim 7, wherein a transparent protective layer is positioned between the monitor and said face plate for protecting the monitor.

11. An enclosure for housing a visual display device as set forth in claim 7, wherein a transparent protective layer is positioned between the monitor and said face plate for protecting the monitor;

said transparent protective layer including a first layer edge, a second layer edge, a third layer edge and a four layer edge for defining a layer area;

said layer area of said transparent protective layer being greater than said cabinet aperture and less than said face plate; and said first layer edge, said second layer edge, said third layer edge and said four layer edge including a continuous groove engaging said top edge, said bottom edge, said first edge and said second edge respectively for interlocking said transparent protective layer to said cabinet.

12. An enclosure for housing a visual display device as set forth in claim 7, wherein said first coupling includes a first cam lever receiver on said top panel;

a first cam lock traversing said top pyramid shield;

a first cam lever pivotally secured to said first cam lock within said cover chamber of said pyramid body; and said first cam lever engaging said first cam lever receiver for locking said pyramid body to said cabinet.

13. An enclosure for housing a visual display device as set forth in claim 7, wherein said second coupling including a second cam lever receiver on said bottom panel;

a second cam lock traversing said bottom pyramid shield;

a second cam lever pivotally secured to said second cam lock within said cover chamber of said pyramid body; and said second cam lever engaging said second cam lever receiver for locking said pyramid body to said cabinet.

14. An enclosure for housing a visual display device as set forth in claim 7, wherein said first side panel including a first opening for accessing the memory device; and said second side panel including a second opening for accessing the memory device.

15. An enclosure for housing a visual display device as set forth in claim 7, wherein said face plate and said top pyramid shield, said bottom pyramid shield, said first side pyramid shield and said second side pyramid shield define an obtuse angle.

16. An enclosure for housing a visual display device adjacent to a surface, the visual display device including a monitor for displaying a viewable image, the monitor being electrically coupled to a memory device, the memory device providing electronic signals to the monitor, the enclosure, comprising:

a cabinet including a base panel, a top panel, a bottom panel, a first side panel and a second side panel for defining a cabinet chamber;

said cabinet defining a continuous cabinet depth;

a face plate including a top elongated plate, a bottom elongated plate, a first side elongated plate and a second side elongated plate for defining a continuous frame;

said top elongated plate, said bottom elongated plate, said first side elongated plate and said second side elongated plate defining an interior frame aperture;

a pyramid body including a top pyramid shield, a bottom pyramid shield, a first side pyramid shield and a second side pyramid shield for defining a cover chamber;

said face plate and said pyramid body being an integral one piece unit;

said face plate and said pyramid body defining a continuous cover depth;

a fastener securing said cabinet to the surface;

said cabinet chamber receiving the visual display device;

said continuous cabinet depth being less than said continuous cover depth for positioning said cabinet within said cover chamber of said pyramid body;

said top elongated plate, said bottom elongated plate, said first side elongated plate and said second side elongated plate compressing against said top panel, said bottom panel, said first side panel and said second side panel respectively, for simultaneously positioning said interior frame aperture over the monitor and positioning said pyramid body adjacent to the surface;

said cabinet including a cam lever receiver;

a cam lock traversing said pyramid body;

a cam lever pivotally secured to said cam lock within said cover chamber of said pyramid body; and said cam lever engaging said cam lever receiver for locking said pyramid body to said cabinet.

* * * * *